United States Patent [19]

Cyron et al.

[11] Patent Number: 4,795,615

[45] Date of Patent: Jan. 3, 1989

[54] MOUNTING FOR A METALLIC EXHAUST GAS CATALYST CARRIER BODY AND METHOD FOR MANUFACTURING THE SAME

[75] Inventors: Theodor Cyron; Wolfgang Maus, both of Bergisch-Gladbach, Fed. Rep. of Germany

[73] Assignee: Interatom GmbH, Bergisch-Gladbach, Fed. Rep. of Germany

[21] Appl. No.: 70,034

[22] Filed: Jul. 6, 1987

Related U.S. Application Data

[63] Continuation-in-part of Ser. No. 888,827, Jul. 22, 1986, abandoned.

[30] Foreign Application Priority Data

Jul. 25, 1985 [DE] Fed. Rep. of Germany ..... 3526681

[51] Int. Cl.[4] ..... F01N 3/15

[52] U.S. Cl. ..... 422/179; 422/180; 422/181; 422/221; 422/222; 29/451; 29/157 R; 29/455.1

[58] Field of Search ..... 422/179, 180, 221, 222, 422/181; 29/451, 455 R, 157 R; 502/439, 527; 423/213.5

[56] References Cited

U.S. PATENT DOCUMENTS

| | | | |
|---|---|---|---|
| 3,892,537 | 7/1975 | Gulati et al. | 422/180 |
| 3,937,617 | 2/1976 | Yaguchi | 422/179 |
| 3,948,611 | 4/1976 | Stawsky | 422/180 |
| 4,142,864 | 3/1979 | Rosynsky | 422/180 |
| 4,143,117 | 3/1979 | Gaysert | 422/180 |
| 4,155,980 | 5/1979 | Santiago et al. | 422/180 |
| 4,163,041 | 7/1979 | Gaysert | 422/179 |
| 4,285,909 | 8/1981 | Mizusawa et al. . | |
| 4,324,701 | 4/1982 | Honda et al. | 502/527 |
| 4,344,921 | 8/1982 | Santiago et al. | 422/180 |
| 4,665,051 | 5/1987 | Nonnenmann | 502/439 |

FOREIGN PATENT DOCUMENTS

| | | | |
|---|---|---|---|
| 1192624 | 5/1965 | Fed. Rep. of Germany . | |
| 2301273 | 7/1973 | Fed. Rep. of Germany | 422/179 |
| 2302746 | 7/1974 | Fed. Rep. of Germany . | |
| 2924592 | 1/1981 | Fed. Rep. of Germany . | |
| 3312944 | 10/1984 | Fed. Rep. of Germany . | |
| 2209399 | 6/1974 | France . | |

*Primary Examiner*—David L. Lacey
*Assistant Examiner*—Lori-Ann Johnson
*Attorney, Agent, or Firm*—Herbert L. Lerner; Laurence A. Geenberg

[57] ABSTRACT

A mounting assembly for an exhaust gas catalyst and a method for manufacturing the same includes a metallic exhaust gas catalyst carrier body formed of a multiplicity of layers, at least one first brazed joint interconnecting the layers, a metallic tubular jacket in which the catalyst carrier body is disposed, and one second brazed joint fastening the catalyst carrier body to the tubular jacket while permitting lengthwise expansion of the catalyst carrier body relative to the tubular jacket.

31 Claims, 2 Drawing Sheets

MOUNTING FOR A METALLIC EXHAUST GAS CATALYST CARRIER BODY AND METHOD FOR MANUFACTURING THE SAME

CROSS REFERENCE TO RELATED APPLICATIONS

This application is a continuation-in-part of application Ser. No. 888,827, filed July 22, 1986 now abandoned.

The invention relates to a mounting for a metallic exhaust gas catalyst carrier body, including a tubular jacket in which the catalyst carrier body is embedded. The subject matter of the invention is therefore distinguished from exhaust gas catalysts having ceramic elements.

Metallic exhaust gas catalyst carrier bodies are known, for instance, from German Published, Non-Prosecuted Applications DE-OS No. 29 24 592 and DE-OS No. 33 12 944, the latter being in a more developed form. Such exhaust gas catalyst carrier bodies are coated with a catalyst material which causes the decontamination of exhaust gases. In the operating state, the catalyst carrier bodies are subjected over long periods of time to high temperatures and to alternating stresses. In addition, they must be made of high-temperature resistant steel alloys which are only slightly corrosion-prone.

During the installation of such catalyst carrier bodies in the exhaust gas systems of motor vehicles, the mounting of the bodies presents a particular problem. The catalyst carrier bodies must be installed in a strong housing, such as a tubular jacket and furthermore they have to be thermally insulated. Problems arise in this connection, since the carrier bodies are subjected to expansion particularly in the longitudinal direction, at high temperatures and with increasing operating times.

If this expansion is impeded, such as by firm connections with a tubular jacket in more than one zone along the axial length, this leads to a progressive destruction of the jacket zone of the carrier body until it separates from the jacket. In addition, the otherwise good start-up behavior of a catalyst with a metallic carrier body is deteriorated if the thick tubular jacket must first be heated up concurrently during the starting phase.

FIG. 6 of British Pat. No. 1,452,982 discloses a catalyst body in which a metallic body is supported separately from the tubular jacket thereof. Although such a structure is effective in limiting the negative effects of the different thermal expansions of the elements, it cannot overcome the problem caused by the fact that the honeycomb catalyst carrier body slowly grows during the service life thereof, so that the length thereof increases with respect to that of the tubular jacket. If the catalyst carrier body is connected to the tubular jacket over the entire length thereof, or even at two locations which are spaced apart from each other, the growth of the catalyst carrier body will lead to premature destruction of the device.

It is accordingly an object of the invention to provide a mounting for a metallic exhaust gas catalyst carrier body and a method for manufacturing the same, which overcomes the hereinafore-mentioned disadvantages of the heretofore-known devices and methods of this general type and which provides the longest possible service life of the carrier body, but can nevertheless be produced cost-effectively and simply.

With the foregoing and other objects in view there is provided, in accordance with the invention, a mounting assembly for an exhaust gas catalyst, comprising a metallic exhaust gas catalyst carrier body formed of a multiplicity of layers, at least one first brazed joint interconnecting the layers, a metallic tubular jacket in which the catalyst carrier body is disposed, and one second brazed joint fastening the catalyst carrier body to the tubular jacket while permitting lengthwise expansion of the catalyst carrier body relative to the tubular jacket.

The use of only one brazed joint between the catalyst carrier body and the tubular jacket prevents destruction of the device due to growth of the catalyst carrier body because it permits lengthwise expansion of the catalyst carrier body relative to the tubular jacket. Embedding a catalyst carrier body in a tubular jacket according to the invention, without decisively impeding its longitudinal expansion, reduces the mechanical stress during its service life and during individual operating cycles.

In accordance with another feature of the invention, the first and second brazed joints are axially spaced apart from each other.

In accordance with a further feature of the invention, the second brazed joint is in the form of brazing foil.

In accordance with an added feature of the invention, the brazing foil is disposed at a substantially central portion of the periphery of the catalyst carrier body. If the zone for fastening to the tubular jacket is disposed approximately in the center of the axial length of the catalyst carrier body, a further advantage can be achieved in connection with catalyst carrier bodies which would otherwise be brazed in narrow areas at the end face, namely, reduced stress of the structure of the catalyst carrier body due to radial thermal movements. In the vicinity of the relatively rigidly brazed end faces, there is then no firm connection to the tubular jacket, so that damage in this area is prevented, while the connection to the tubular jacket is located in a comparatively elastic region in which no damage is expected.

In accordance with an additional feature of the invention, the second brazed joint is disposed at an end of the periphery of the catalyst carrier body.

In accordance with yet another feature of the invention, the brazing foil is disposed at an end of the periphery of the catalyst carrier body.

In accordance with yet a further feature of the invention, the catalyst carrier body is recessed inside both ends of the tubular body. These recesses can accommodate the growth of the catalyst carrier body.

In accordance with yet an added feature of the invention, the second brazed joint includes metallic bridges with a heat conductivity as small as possible between the catalyst carrier body and the tubular jacket.

In connection with this measure a far-reaching thermal insulation between the catalyst carrier body and the tubular jacket can be achieved as a further or possibly even a separate advantage. The fewer the firm metallic bridges being disposed between these two parts, or the lower the thermal conductivity of such bridges, the faster the catalyst carrier body is heated at the start of the operation, since less heat is transferred to the thick jacket. Furthermore, the overall operating temperatures of the jacket are lower, for which reason external thermal insulation can be reduced or eliminated altogether.

In accordance with yet an additional feature of the invention, the second brazed joint fastens a portion of the periphery of the catalyst carrier body to the tubular jacket or includes a brazed joint fastening an end surface or fastens a portion covering 1 to 20 mm in axial direction of the periphery of the catalyst carrier body to the tubular jacket all of which permit lengthwise expansion in at least one direction. The criticality of this dimension is that it is large enough to firmly hold the parts together, yet small enough to allow axial movement.

This is a simple embodiment of the invention. Due to the fact that the carrier body still is fastened only in a zone of its circumference which is narrow in the axial direction and covers, for instance, 1 to 20 mm width in a tubular jacket, its lengthwise expansion is not inhibited so that length changes generated by thermal alternating stresses as well as enlargements occurring over the course of time due to changes of the material, cannot lead to a premature destruction of the carrier body. If the zone for fastening to the tubular jacket is disposed approximately in the center of the axial length of the catalyst carrier body, a further advantage can be achieved in connection with catalyst carrier bodies which would otherwise be brazed in narrow areas at the end face, namely, reduced stress of the structure of the catalyst carrier body due to radial thermal movements. In the vicinity of the relatively rigidly brazed end faces, there is then no firm connection to the tubular jacket, so that damage in this area is prevented, while the connection to the tubular jacket is located in a comparatively elastic region in which no damage is expected.

In accordance with still another feature of the invention, the second brazed joint includes a spaces and there is provided at least one other spacer maintaining a distance of several, preferably 1–5 mm, between the catalyst carrier body and the tubular jacket. This provides a mounting which is particularly advantageous with respect to the thermal insulation and the free longitudinal expansion, particularly in conjunction with the embodiments described below, as will be explained in greater detail by reference to the drawing.

In accordance with still a further feature of the invention, the spacers are collar-shaped and only one of the spacers is firmly connected to the catalyst carrier body as well as to the tubular jacket.

In accordance with still an added feature of the invention, the second brazed joint maintains a space between the tubular jacket and the catalyst carrier body, and including a high-temperature resistant heat insulating material at least partially filling the space.

In accordance with still an additional feature of the invention, the heat insulating material is a flowable high-temperature resistant granulate, powder or fine quartz sand. The criticality of such a material is that although it settles to the bottom, when the inner metallic elements expand more than the outer metallic elements because they are heated more, the flowable material will travel up to fill the gap.

In accordance with again another feature of the invention, the second brazed joint maintains a space between the tubular jacket and the catalyst carrier body, and there is provided a flowable high-temperature resistant heat insulating material at least partially filling the space, the catalyst carrier body and the tubular jacket having inner surfaces, and the spacers other than the first-mentioned spacer are each connected to one of the surfaces and forming sealing lips preventing the flowable material such as granulate or powder from escaping even in the event of longitudinal expansions of the catalyst carrier body.

In accordance with again a further feature of the invention, the heat insulating material is flowable, and there are provided substantially radial bridges in the space extending in longitudinal direction of the catalyst carrier body and loosely or non-firmly interconnecting the catalyst carrier and the tubular jacket with play.

In accordance with again an added feature of the invention, the collar-shaped spacers and/or bridges are formed of metallic woven screens.

In accordance with again an additional feature of the invention, the layers are in the form of alternating smooth and corrugated layers.

The space formed between the catalyst carrier body and the tubular jacket can be filled with various high-temperature resistant thermal insulation materials. Thus, ceramic fiber mats used in some mountings for ceramic catalyst carrier bodies, are suitable on one hand, but on the other hand, the high-temperature flowable granulates or powders proposed according to the present invention can be used. For instance, fine quartz sand is suitable. In horizontal installations of the catalyst carrier body, flowable material also always shakes firmly down again if the catalyst carrier body executes expansion and other motions. In this manner, any tendency to vibrate is damped and the carrier body is supported securely over a long service life. Should the volume of the interspace increase, the material nevertheless always trickles down and prevents the carrier body from bouncing back and forth within the tubular jacket in the radial direction. By suitable shaping of the spacers as sealing lips and through the use of additional bridges which, however, do not form thermal bridges, undesirable shifts of the catalyst carrier body within the tubular jacket can be prevented. Furthermore, the thermal conductivity of these bridges can be reduced additionally by using metallic woven screens for the spacers and/or the bridges.

With the objects of the invention in view, there is also provided a method for manufacturing an exhaust gas catalyst mounting assembly, which comprises:

(a) winding sheets together to form a catalyst carrier body;
(b) fastening the sheets together with at least at one first brazed joint;
(c) slipping at least two collar-shaped spacers on the catalyst carrier body and fastening the spacers to the catalyst carrier body;
(d) slipping the catalyst carrier body with the spacers into a tubular jacket while maintaining a space between the catalyst carrier body and the tubular jacket and simultaneously filling the space with a flowable, high-temperature resistant material; and
(e) fastening one of the spacers to the tubular jacket with one second brazed joint.

In accordance with another mode of the invention, there is provided a method which comprises forming a joint between an inlet cone and the tubular jacket.

A trickling device for slipping the catalyst carrier body with the spacers into the tubular jacket can be formed, for instance, of a funnel-shaped collar which is placed on the tubular jacket and through which the catalyst carrier body with the spacers is pushed into the tubular jacket while flowable material trickles into the space therebetween along the outside of the catalyst carrier body.

In accordance with a further mode of the invention, there is provided a method which comprises performing the step of fastening one of the spacers to the tubular jacket with one second brazed joint at the spacer closest to the joint between the inlet cone and the tubular jacket.

In accordance with an added mode of the invention, there is provided a method which comprises connecting one of the spacers to the tubular jacket in a step separate from the step of forming a joint between the inlet cone and the tubular jacket. This minimizes the number of process steps required.

In accordance with an additional mode of the invention, there is provided a method which comprises providing the flowable, high-temperature resistant material in the form of a granulate or powder.

With the objects of the invention in view there is furthermore provided a method for manufacturing an exhaust gas catalyst mounting assembly, which comprises:

(a) winding sheets together to form a catalyst carrier body;
(b) fastening the sheets together with at least at one first brazed joint;
(c) slipping the catalyst carrier body into a tubular jacket; and
(d) fastening the catalyst carrier body to the tubular jacket with one second brazed joint.

In accordance with yet another mode of the invention, there is provided a method which comprises forming both brazed joints with brazing powder.

In accordance with yet a further mode of the invention, there is provided a method which comprises forming the second brazed joint by wrapping brazing foil around the periphery of the catalyst carrier body.

In accordance with yet a further mode of the invention, there is provided a method which comprises forming the second brazed joint by wrapping brazing foil around an end region of the periphery of the catalyst carrier body.

In accordance with a concomitant mode of the invention, there is provided a method which comprises forming the second brazed joint by wrapping brazing foil around a substantially central region of the periphery of the catalyst carrier body.

Other features which are considered as characteristic for the invention are set forth in the appended claims.

Although the invention is illustrated and described herein as embodied in a mounting for a metallic exhaust gas catalyst carrier body and method for manufacturing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
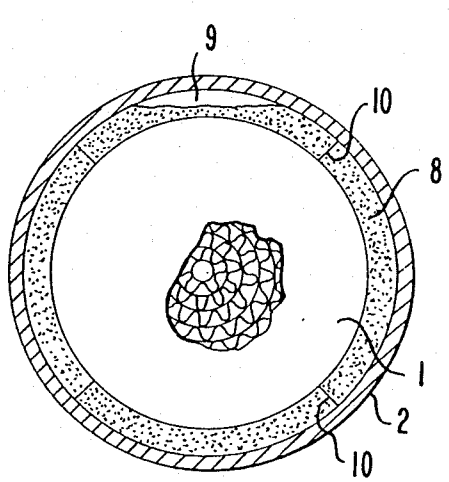
FIG. 2 is a partly broken-away cross-sectional view of the mounting.
Figure 1:
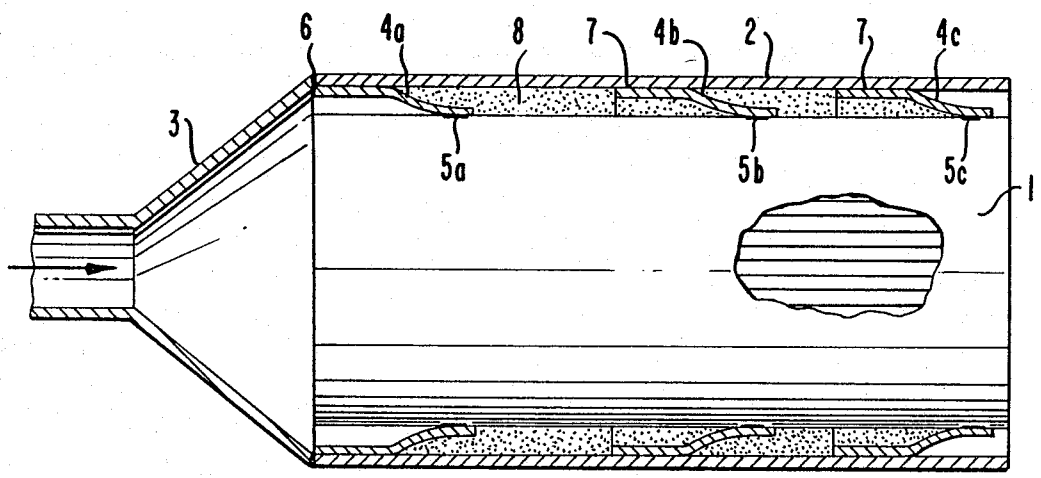
FIG. 1 is a fragmentary, diagrammatic, longitudinal-sectional view, partly broken-away, of a mounting of an exhaust catalyst carrier body according to the invention.

Referring now to the figures of the drawings in detail and first, particularly, to FIG. 1 thereof, there is seen a conventional metallic exhaust gas catalyst carrier body 1 fastened in a tubular jacket 2. Exhaust gas is transported to the catalyst carrier body 1 through an inlet or intake cone 3 and flows through numerous canals in the catalyst carrier body. A connection between the exhaust gas catalyst carrier body 1 and the tubular jacket 2 is made by three collar or ring-shaped spacers 4*a*, 4*b*, 4*c*, which may be formed of metallic woven screens. The spacers 4*a*, 4*b*, 4*c* are fastened by means of suitable joint connections 5*a*, 5*b*, 5*c* on the outer layer of the catalyst carrier body 1. The forward most spacer 4*a* is furthermore joined at reference numeral 6 to the tubular jacket 2. The joint is preferably made at the point at which the inlet cone 3 is also connected to the tubular jacket 2. The other spacers 4*b*, 4*c* are not fastened to the tubular jacket 2, but rather slide along a sealing sealing surface 7 forming lips for flowable material. A space 8 between the tubular jacket 2 and the catalyst carrier body 1 is filled as far as possible with a high-temperature resistant, thermally insulating flowable material, such as quartz sand. This material is always shaken down during the operation of the catalyst, even if the metallic catalyst carrier body executes expansions or other motions. If the volume of the interspace is increased, the flowable material trickles generally downward as shown in FIG. 2, so that a hollow space 9 is formed at the top. Nevertheless, the flowable material still causes considerable damping of the motions of the catalyst carrier body 1 relative to the tubular jacket 2. If necessary, additional radial bridges 10 which extend along the longitudinal direction of the catalyst carrier body 1, can be disposed in the space 8, as also shown in FIG. 2. The bridges 10, which may be formed of metallic flowable screens, subdivide the space into several chambers, so that shifting of the catalyst carrier body 1 from its central position is made more difficult. However, the bridges 10 must not be constructed as a firm connection between the catalyst carrier body 1 and the tubular jacket 2.

The drawing is not to scale and it is therefore noted that is should be understood that the space 8 covers only a few millimeters and is kept as small as the requirements as to heat insulation and the disposition of the spacers 4*a*, 4*b*, 4*c* permit. The spacers 4*a*, 4*b*, 4*c* themselves are formed of sheet metal which is as thin as possible and is in the order of about 0.1 mm. The spacer rings 4*a*, 4*b*, 4*c* only form weak heat bridges between the catalyst carrier body 1 and the tubular jacket 2, while the flowable material in the space 8 represents good thermal insulation. A catalyst carrier body mounted in accordance with the invention therefore requires no thermal insulation or only requires little thermal insulation, as compared to conventional devices with a tubular jacket resting directly against the catalyst carrier body. The mounting also permits a faster start-up of the catalyst.

Figure 3:
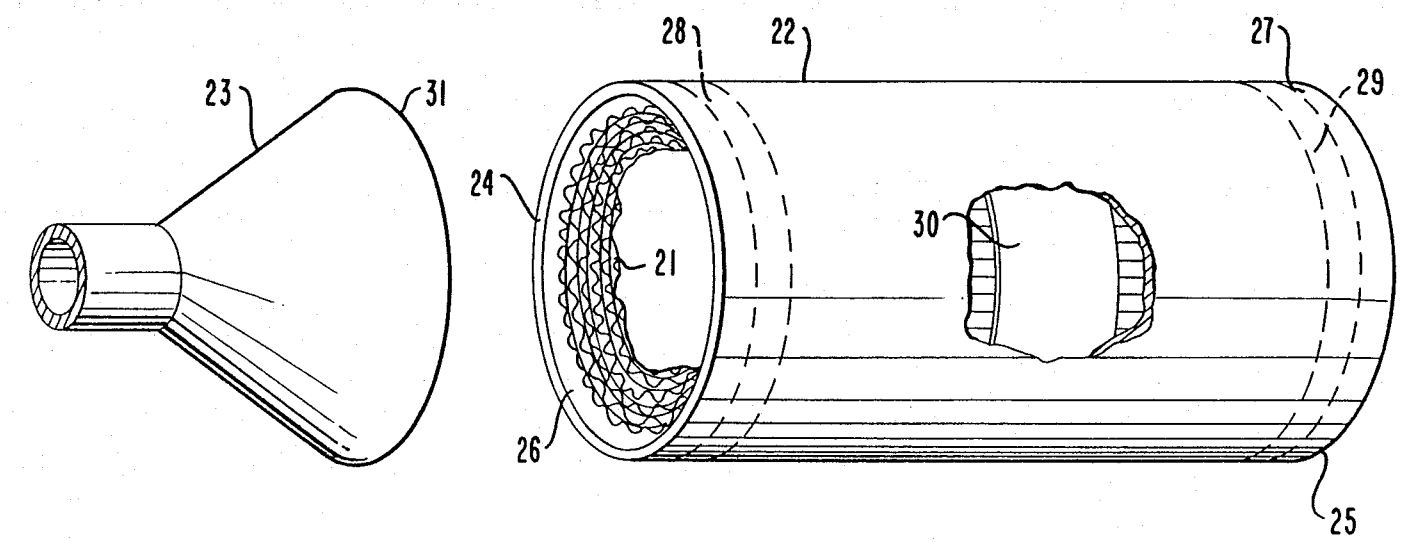
FIG. 3 is a fragmentary, diagrammatic, exploded perspective view, partly broken-away, of another embodiment wherein the inlet or outlet cone has been separated from the tubular jacket.

FIG. 3 illustrats an embodiment of the invention wherein a wound catalyst carrier body 21 in the form of a honeycomb body formed of alternating flat and corrugated or wavy sheets is disposed within a tubular jacket 22. The catalyst carrier body has been broken away in the drawing, but it is understood that it is completely wound like that of FIGS. 1 and 2. The catalyst carrier body 21 is recessed from the edges 24, 25 of the tubular jacket 22 defining spaces 26, 27, respectively, therebetween.

Before the catalyst carrier body 21 is placed in the tubular jacket 22, brazing powder is sprinkled in the catalyst carrier body 21 within at least one zone 28, 29 so as to braze the flat and corrugated sheets to each other. The brazing may also take place in other regions of the catalyst carrier body 21 by simply placing brazing powder where desired. Thus only one or both of the zones 28, 29 may be brazed alone or in any combination with other zones or the brazing may take place only in the other zones.

However, the catalyst carrier body 21 is only brazed to the tubular jacket tubular jacket 22 in one location. Therefore, brazing powder may be placed between the catalyst carrier body 21 and the tubular jacket 22 at one of the zones 28, 29. Furthermore, it has been found to be especially advantageous to braze the catalyst carrier body 21 to the tubular jacket 22 in a location axially spaced apart from the location of the brazed joint(s) interconnecting the sheets to each other. Therefore, a brazing foil 30 may be placed on the catalyst carrier body 21 before insertion into the tubular jacket 22. Additionally, it is also possible to place the foil at a location covering one of the zones 28, 29 or at any other location instead of placing it at the center of the tubular jacket. The advantage of the brazing foil is that it brazes in a defined location whereas the brazing powder may travel beyond the desired location when sprinkled in.

It is thus clear that the FIG. 3 embodiment includes at least one inner connection brazing the sheets of the catalyst carrier body to each other and only one outer connection brazing the catalyst carrier body to the tubular jacket. The fact that only a single outer connection is provided between the catalyst carrier body and the tubular jacket not only prevents the different thermal expansions of the two parts from harming the structure, but it also prevents harm from being caused by the slow growth of the catalyst carrier body as compared to the tubular jacket. When a connection between the two parts extends over the entire lengths thereof or even if a connection is provided at several locations, premature destruction of the parts results due to this difference in thermal expansions and in growth.

After the intermediate product formed of the catalyst carrier body and the tubular jacket has been completed, it may be connected to a cone 23. The cone will be an inlet or intake cone if the edge 31 thereof is welded to the edge 24 of the tubular jacket 22 and it will be an outlet cone if it is welded to the edge 25 thereof.

Catalyst carrier bodies mounted in accordance with the invention are suitable for installation near the engine as well as for installation underneath the bottom tray or floor of motor vehicles.

We claim:

1. Mounting assembly for an exhaust gas catalyst, comprising a metallic exhaust gas catalyst carrier body formed of a multiplicity of layers, at least one first brazed joint interconnecting said layers, a metallic tubular jacket in which said catalyst carrier body is disposed, and one second brazed joint fastening said catalyst carrier body to said tubular jacket while permitting lengthwise expansion of said catalyst carrier body relative to said tubular jacket, said first and second brazed joints being axially spaced apart from each other.

2. Mounting assembly according to claim 1, wherein said second brazed joint is in the form of brazing foil.

3. Mounting assembly according to claim 2, wherein said brazing foil is disposed at a substantially central portion of the periphery of said catalyst carrier body.

4. Mounting assembly according to claim 2, wherein said brazing foil is disposed at an end of the periphery of said catalyst carrier body.

5. Mounting assembly according to claim 1, wherein said second brazed joint is disposed at an end of the periphery of said catalyst carrier body.

6. Mounting assembly according to claim 1, wherein said catalyst carrier body is recessed inside both ends of said tubular body.

7. Mounting assembly according to claim 1, wherein said second brazed joint includes metallic bridges between said catalyst carrier body and said tubular jacket having a heat conductivity small enough to minimize heat from reaching said tubular jacket.

8. Mounting assembly according to claim 1, wherein said second brazed joint fastens a portion covering 1 to 20 mm in axial direction of the periphery of said catalyst carrier body to said tubular jacket.

9. Mounting assembly according to claim 1, wherein said second brazed joint includes a spacer, and including at least one other spacer, said spacers maintaining a distance of several mm between said catalyst carrier body and said tubular jacket.

10. Mounting assembly according to claim 9, wherein said spacers are collar-shaped and only said first-mentioned spacer is firmly connected to said catalyst carrier body as well as to said tubular jacket.

11. Mounting assembly according to claim 9, wherein said second brazed joint maintains a space between said tubular jacket and said catalyst carrier body, and including a flowable high-temperature resistant heat insulating material at least partially filling said space, said catalyst carrier body having a peripheral surface and said tubular jacket having an inner surface, and said spacers other than said spacer which is connected to both said peripheral surface and said inner surface, each being connected to one of said surfaces and forming sealing lips preventing said flowable material from escaping even in the event of longitudinal expansions of said catalyst carrier body.

12. Mounting assembly according to claim 10, wherein said collar-shaped spacers are formed of metallic woven screens.

13. Mounting assembly according to claim 1, wherein said second brazed joint maintains a space between said tubular jacket and said catalyst carrier body, and including a high-temperature resistant heat insulating material at least partially filling said space.

14. Mounting assembly according to claim 13, wherein said heat insulating material is a flowable high-temperature resistant granulate.

15. Mounting assembly according to claim 13, wherein said heat insulating material is a flowable high-temperature resistant powder.

16. Mounting assembly according to claim 13, wherein said heat insulating material is a flowable high-temperature resistant fine quartz sand.

17. Mounting assembly according to claim 13, including substantially radial bridges in said space extending in the longitudinal direction of said catalyst carrier body and loosely interconnecting said catalyst carrier and said tubular jacket.

18. Mounting assembly according to claim 13, wherein said heat insulating material is flowable, and including substantially radial bridges in said space extending in the longitudinal direction of said catalyst carrier body and loosely interconnecting said catalyst carrier and said tubular jacket.

19. Mounting assembly according to claim 18, wherein said bridges are formed of metallic woven screens.

20. Mounting assembly according to claim 1, wherein said layers are in the form of alternating smooth and corrugated layers.

21. Method for manufacturing an exhaust gas catalyst mounting assembly, which comprises:

(a) winding sheets together to form a catalyst carrier body;

(b) fastening the sheets together with at least at one first brazed joint;

(c) slipping at least two collar-shaped spacers on the catalyst carrier body and fastening the spacers to the catalyst carrier body;

(d) slipping the catalyst carrier body with the spacers into a tubular jacket while maintaining a space between the catalyst carrier body and the tubular jacket and simultaneously filling the space with a flowable, high-temperature resistant material; and (e) fastening one of the spacers to the tubular jacket with one second brazed joint axially spaced apart from the at least one first brazed joint.

22. Method according to claim 21, which comprises forming a joint between an inlet cone and the tubular jacket.

23. Method according to claim 22, which comprises performing the step of fastening one of the spacers to the tubular jacket with one second brazed joint at the spacer closest to the joint between the inlet cone and the tubular jacket.

24. Method according to claim 22, which comprises connecting one of the spacers to the tubular jacket in a step separate from the step of forming a joint between the inlet cone and the tubular jacket.

25. Method according to claim 21, which comprises providing the flowable, high-temperature resistant material in the form of a granulate.

26. Method according to claim 21, which comprises providing the flowable, high-temperature resistant material in the form of a powder.

27. Method for manufacturing an exhaust gas catalyst mounting assembly, which comprises:

(a) winding sheets together to form a catalyst carrier body;

(b) fastening the sheets together with at least at one first brazed joint;

(c) slipping the catalyst carrier body into a tubular jacket; and (d) fastening the catalyst carrier body to the tubular jacket with one second brazed joint axially spaced apart from the at least one first brazed joint.

28. Method according to claim 27, which comprises forming both brazed joints with brazing powder.

29. Method according to claim 27, which comprises forming the second brazed joint by wrapping brazing foil around the periphery of the catalyst carrier body.

30. Method according to claim 27, which comprises forming the second brazed joint by wrapping brazing foil around an end region of the periphery of the catalyst carrier body.

31. Method according to claim 27, which comprises forming the second brazed joint by wrapping brazing foil around a substantially central region of the periphery of the catalyst carrier body.

* * * * *